US008708731B2

(12) United States Patent
Chatelus

(10) Patent No.: US 8,708,731 B2
(45) Date of Patent: Apr. 29, 2014

(54) ELECTRICAL ASSEMBLY WITH SOCKET AND PLUG

(75) Inventor: Eric Chatelus, Bourg-la-Reine (FR)

(73) Assignee: Tyco Electronics France SAS, Pointoise (FR)

( * ) Notice: Subject to any disclaimer, the term of this patent is extended or adjusted under 35 U.S.C. 154(b) by 0 days.

(21) Appl. No.: 13/498,085

(22) PCT Filed: Sep. 17, 2010

(86) PCT No.: PCT/EP2010/063691
§ 371 (c)(1),
(2), (4) Date: Mar. 23, 2012

(87) PCT Pub. No.: WO2011/036101
PCT Pub. Date: Mar. 31, 2011

(65) Prior Publication Data

US 2013/0023143 A1 Jan. 24, 2013

(30) Foreign Application Priority Data

Sep. 24, 2009 (EP) ..... 09290724

(51) Int. Cl.
*H01R 13/627* (2006.01)

(52) U.S. Cl.
USPC ..... 439/350; 439/592

(58) Field of Classification Search
USPC ..... 439/592, 350–352
See application file for complete search history.

(56) References Cited

U.S. PATENT DOCUMENTS 3,133,777 A 5/1964 Anhalt
4,017,139 A * 4/1977 Nelson ..... 439/352
4,333,699 A * 6/1982 Brorein ..... 439/592
4,431,244 A * 2/1984 Anhalt et al. ..... 439/358
4,921,448 A * 5/1990 Endo et al. ..... 439/595
5,055,065 A * 10/1991 Pearl ..... 439/425
5,195,904 A * 3/1993 Cyvoct ..... 439/349
5,314,347 A * 5/1994 Colleran et al. ..... 439/350

(Continued)

FOREIGN PATENT DOCUMENTS

DE 2215221 A1 10/1973

OTHER PUBLICATIONS

International Preliminary Report on Patentability issued by The International Bureau of WIPO, dated Mar. 27, 2012 for related International Application No. PCT/EP2010/063691; 10 pages.

(Continued)

*Primary Examiner* — Ross Gushi
(74) *Attorney, Agent, or Firm* — Faegre Baker Daniels LLP

(57) ABSTRACT

The invention relates to a plug assembly (1), a socket (2, 2') and a plug with a plug member (3, 3'), wherein the socket (2, 2') is shaped with a hollow receiving section (4) for receiving the plug member (3, 3') in a mating direction (M). In order to latch or unlatch the plug assembly (1) the hollow receiving section (4) comprises at least one actuating zone (36), which can be deformed perpendicular to the mating direction (M), resulting in a movement of a latching element (9) of the receiving section (4). For improving the handling of the plug assembly (1), especially while connecting, the present invention provides that the socket (2, 2') comprises supporting elements (29, 30, 31), which rest on an outer wall guiding section (13) of the plug member (3, 3'), assuring that only a proper deformation of the actuating zone (38, 39) occurs while mating the plug and the socket.

15 Claims, 6 Drawing Sheets

(56) References Cited

U.S. PATENT DOCUMENTS

| | | | | |
|---|---|---|---|---|
| 5,338,219 | A * | 8/1994 | Hiramoto et al. | 439/350 |
| 5,380,217 | A * | 1/1995 | Yagi et al. | 439/358 |
| 5,549,490 | A * | 8/1996 | Buetas | 439/724 |
| 5,554,042 | A * | 9/1996 | Denninger | 439/272 |
| 5,637,010 | A * | 6/1997 | Jost et al. | 439/352 |
| 5,692,923 | A * | 12/1997 | Sawada | 439/555 |
| 5,718,596 | A * | 2/1998 | Inaba et al. | 439/352 |
| 5,830,000 | A * | 11/1998 | Shifflett et al. | 439/352 |
| 6,056,577 | A * | 5/2000 | Blanchet | 439/352 |
| 6,095,844 | A * | 8/2000 | Kasai | 439/352 |
| 6,142,812 | A * | 11/2000 | Hwang | 439/352 |
| 6,171,130 | B1 * | 1/2001 | Yoshida et al. | 439/352 |
| 6,186,818 | B1 * | 2/2001 | Hung | 439/357 |
| 6,206,716 | B1 * | 3/2001 | Saito | 439/352 |
| 6,217,365 | B1 * | 4/2001 | Shinozaki | 439/358 |
| 6,461,056 | B1 * | 10/2002 | Besler et al. | 385/76 |
| 6,464,526 | B1 * | 10/2002 | Seufert et al. | 439/352 |
| 6,537,099 | B2 * | 3/2003 | Herlinger et al. | 439/352 |
| 6,645,011 | B2 * | 11/2003 | Schneider et al. | 439/607.17 |
| 6,655,978 | B2 * | 12/2003 | Lutsch et al. | 439/352 |
| 6,736,662 | B2 * | 5/2004 | Lin | 439/350 |
| 6,746,266 | B2 * | 6/2004 | Cheng | 439/352 |
| 7,318,739 | B2 * | 1/2008 | Abe | 439/350 |
| 7,326,074 | B1 * | 2/2008 | Lim et al. | 439/352 |
| 7,347,710 | B2 * | 3/2008 | Ohtaka et al. | 439/352 |
| 7,381,084 | B1 * | 6/2008 | Horn et al. | 439/489 |
| 7,402,069 | B2 * | 7/2008 | Shigeta et al. | 439/352 |
| 7,455,545 | B2 * | 11/2008 | Chawgo et al. | 439/353 |
| 7,465,185 | B2 * | 12/2008 | Tyler | 439/467 |
| 7,476,118 | B2 * | 1/2009 | Amidon | 439/353 |
| 7,503,793 | B2 * | 3/2009 | Morello | 439/352 |
| 7,549,887 | B1 * | 6/2009 | Ng et al. | 439/352 |
| 7,618,278 | B2 * | 11/2009 | Burk et al. | 439/352 |
| 7,695,302 | B2 * | 4/2010 | Eissner et al. | 439/352 |
| 7,857,652 | B2 * | 12/2010 | Amidon | 439/353 |
| 7,892,014 | B2 * | 2/2011 | Amidon et al. | 439/353 |
| 7,950,947 | B2 * | 5/2011 | Amidon | 439/353 |
| 7,950,948 | B2 * | 5/2011 | Amidon | 439/353 |
| 7,993,154 | B2 * | 8/2011 | Baughn et al. | 439/352 |
| 8,011,942 | B2 * | 9/2011 | Ohmori et al. | 439/314 |
| 8,038,463 | B2 * | 10/2011 | Ferderer | 439/350 |
| 8,043,106 | B1 * | 10/2011 | Morello et al. | 439/352 |
| 8,075,332 | B2 * | 12/2011 | Amidon | 439/353 |
| 8,257,104 | B2 * | 9/2012 | Ferderer | 439/350 |
| 2001/0024899 | A1 * | 9/2001 | Geltsch et al. | 439/350 |
| 2002/0006745 | A1 * | 1/2002 | Nakamura | 439/352 |
| 2002/0111060 | A1 * | 8/2002 | Challis et al. | 439/352 |
| 2003/0022544 | A1 * | 1/2003 | Hattori | 439/350 |
| 2003/0040210 | A1 * | 2/2003 | Herlinger et al. | 439/352 |
| 2003/0087545 | A1 * | 5/2003 | Nimura | 439/352 |
| 2003/0157825 | A1 * | 8/2003 | Kane | 439/352 |
| 2003/0162431 | A1 * | 8/2003 | Schmidt et al. | 439/350 |
| 2008/0014781 | A1 * | 1/2008 | Burk et al. | 439/352 |
| 2008/0305683 | A1 * | 12/2008 | Li et al. | 439/607 |
| 2009/0215302 | A1 * | 8/2009 | Roberts | 439/350 |
| 2010/0112844 | A1 * | 5/2010 | Manser | 439/350 |
| 2012/0238124 | A1 * | 9/2012 | Zhao | 439/350 |
| 2013/0023143 | A1 * | 1/2013 | Chatelus | 439/332 |

OTHER PUBLICATIONS

International Search Report and Written Opinion issued by the European Patent Office, dated Oct. 10, 2010, for related International Application No. PCT/EP2010/063691; 13 pages.

European Search Report issued by the European Patent Office, dated Feb. 3, 2010, for European Patent Application No. 09290724.5; 7 pages.

* cited by examiner

ELECTRICAL ASSEMBLY WITH SOCKET AND PLUG

The present invention relates to an electrical socket with a housing that is adapted to be mated with an electrical plug in a mating direction, the housing comprising a hollow and essentially cylindrical receiving section for receiving the plug, with at least one actuating zone that is adapted to be manually, elastically deformed in an actuating direction running perpendicular to the mating direction and towards the interior of the housing, and with a displacement zone, which comprises a latching element that faces in the mating direction, the displacement zone being adapted to move from a initial position to a deflected position in a radial direction running perpendicular to the mating direction and away from the interior of the housing when the at least one actuating zone is deformed in the actuating direction.

Further, the present invention relates to an electrical plug with an essentially cylindrical plug member, the plug member extending in a mating direction and being adapted to be mated with an electrical socket, the plug member comprising at least one outer wall guiding section, which extends in the mating direction, and with a latching member, which faces against the mating direction and at least section-wise projects from the plug member in a radial direction perpendicular to the mating direction.

Moreover, the present invention relates to a plug assembly with at least one plug and at least one socket, the socket being adapted to be mated with the plug.

Furthermore, the present invention relates to a method for connecting a plug and a socket, wherein a plug member of the plug is inserted into a receiving section of the socket in a mating direction.

Electrical sockets with manually elastically deformable actuating zones, which can be deformed during an unlatching procedure and corresponding plugs with outer wall guiding sections and latching members as well as plug connections comprising the before-mentioned sockets and plugs are known from the prior art and are, for instance, described in the German patent application DE 32 37 093 A1. The connection assembly described in this document comprises a socket with a cylindrical housing and a receiving section, the receiving section extending in the mating direction and having an elliptical footprint. On an inner wall of the receiving section, there are two latching protrusions arranged opposite to each other, the latching protrusions being placed in the vertices of the flatter sides of the ellipse. When the main vertices of the more crooked side of the ellipse, hence the actuating zones, are pushed towards each other, the distance between the latching protrusions increases and the protrusions are moved further away from each other from their home or latching position into a deflected or unlocking position. The latching protrusions are thus located in displacement zones of the receiving section.

The connection arrangement of the German patent DE 41 19 122 C2 differs from the above assembly by an elastically deformable receiving section, which comprises an octagonal base.

Known sockets and plugs as mentioned above and described in the prior art, suffer from the disadvantage that during the connecting procedure, the forces necessary for establishing a proper connection remain essentially constant. Only at the end of the connecting procedure, a connecting force acting against the plug direction rises sharply, as the plug reaches his final connecting position. If, however, the connecting procedure is disturbed, e.g. by a canted or blocked plug, the connecting force may rise, too. The operator may not be able to distinguish the different reasons for the rising connecting force, and, if no other verification of the status of the connection is available, the user may erroneously consider the connecting procedure to be successfully concluded.

In view of the disadvantages of the prior art mentioned above, an object underlying the invention is to provide a socket and a plug for a plug connection as well as a method for connecting a plug and a socket with an increased security of connection.

This object is achieved according to the invention for the electric socket mentioned in the beginning in that the receiving section comprises at least one supporting element, which is arranged on an inner surface of the receiving section.

For the electrical plug mentioned above, the object is achieved according to the invention in that the plug member comprises at least one deformation indentation that extends into the mating direction and that is located before the guiding section in the mating direction.

For the plug assembly mentioned above, the object is achieved according to the present invention in that the socket and the plug are configured according to the invention, wherein the at least one supporting surface section rests on the plug member at least when the plug and the socket are partly mated in the mating direction.

For the method mentioned above, the object is achieved according to the present invention in that the connecting proceeds in three consecutive phases, which comprise the steps of:

- inserting the plug member at least sectionwise into the receiving section, whereby the receiving section is at least sectionwise elastically deformed and a rising connection force, which is at least partially directed against the plug direction, acts onto the plug member until the receiving section at least sectionwise reaches a deflected position in a first or deformation phase,
- further inserting the plug member into the receiving section during the second or sliding phase, whereby the receiving section remains in the deflected position while sliding on the plug member, and whereby the connecting force at the beginning of the second or sliding phase drops to a value, which is lower than the connecting force at the end of the first phase,
- until, in a third or latching phase, the receiving section returns from the deflected position into a locking position, in which the socket and the plug are completely mated.

These simple solutions provide that the connecting force sharply drops in the middle of the connecting procedure, leading to a characteristic jerkily completion of the connecting procedure, by which the blockade of the plug is suparable on the one hand, and by which, on the other hand, the operator receives a central signal that the plug procedure is successfully concluded.

The solutions according to the invention can be combined as desired and further improved by the following further embodiments that are advantageous on their own, in each case.

The supporting element may project into the interior of the receiving section and comprise at least one supporting surface section facing to the interior of the receiving section, the actuating zone being arranged between the displacement zone and the supporting element. Alternatively or additionally, the supporting element can be arranged in the area of the actuating zone, preventing an inappropriate deformation of the actuating zone.

Especially during the first phase of the connecting procedure, the plug member can raise the receiving section via the supporting surface, thereby avoiding an inappropriate deformation of the receiving section. Furthermore, the supporting elements can reinforce the receiving section against inappropriate deformation. Also, the arrangement of the actuating zone provides for an easy handling of the mated connection, e.g. during the un-mating procedure.

The receiving section can have a polygonal footprint, the footprint or cross-section comprising at least three, and particularly, at least five or even at least eight or more corners. In order to evenly distribute forces acting on the housing and especially on the actuating zones, an elliptical or a cylindrical cross-section of the housing is especially advantageous. Furthermore, the socket can be adapted to be repeatedly mated and latched or unlatched with the plug. Therefore, at least the receiving section can be elastically deformable transverse to the mating direction. Also, the plug can be adapted to be repeatedly inserted into and removed from the socket.

According to another possible embodiment, the socket may comprise at least one further actuating zone and the actuating zones may be arranged opposite of each other. If the two actuating zones are flanking the displacement zone and if they are pressed towards the interior of the receiving section at the same time, the amplitude of the resulting movement of the displacement zone and the latching element increases. Furthermore, the resulting movement is further directed away from the socket and leads less into a tangential direction of the receiving section. Hence, the size of the latching element, which may be shaped as a latching wall, extending in a radial direction as well as the latching overlap of the latching element and the latching member of the plug can be enlarged, leading to an increased security of the locked or latched plug connection.

In a further advantageous embodiment of the socket, the actuating zones and the supporting elements can be arranged symmetrically around the displacement zone. Deforming the actuating zones in an equal amount towards the interior of the housing then leads to a movement of the displacement zone in the radial direction, which extends perpendicular to the mating direction and away from the receiving section or its longitudinal axis. Influences of actuating zones and supporting elements that are asymmetrically arranged around the displacement zone and which may lead to a movement of the displacement zone in a direction that is tilted with respect to the radial direction into the tangential direction, is at least minimized by this measure. The overlap of the latching element and member can be further increased.

In another advantageous embodiment, the socket can comprise at least one additional supporting element and the supporting elements can be arranged at a maximum distance to each other on the inner surface of the receiving section. The supporting elements can be located in a plane which extends in the mating direction and along the longitudinal axis of the essentially cylindrical housing. Alternatively, the supporting elements can be arranged above the plane, i.e. closer to the latching elements. As the supporting elements limit the possible maximum deflection or deformation of the actuating sections during the un-mating procedure, this results in a socket with a latching mechanism that is less sensible for an inappropriate deformation of the actuating zones, as the actuating zones are smaller and therefore less flexible. However, the amplitude of the resulting movement of the displacement zone and thus the possible maximum overlap of the latching member and the latching element is reduced, which may result in a decreased latching or locking security, if the supporting elements are protruding too far into the receiving section.

Also, the two supporting elements can be located below the plane or further away from the latching element. Here, the amplitude of the displacement of the latching element caused by the deformation of the actuating zones is increased compared to the above two alternatives. However, the actuating zones can be more easily deformed, which may result in an unexpected unlocking of the plug and the socket.

If the plug needs to be secured against unintentional movements in or against the radial direction or shall be supported opposite to the latching member, yet another supporting element can be arranged opposite to the displacement zone. This embodiment with three supporting elements is especially advantageous, as the three supporting elements act as a 3-jaw chuck, optimally fixing the position of the plug in the receiving section and in the radial direction.

In an alternative advantageous embodiment, the socket can be provided with the at least one supporting element and especially with only this supporting element, which may essentially extend over half of the inner surface of the receiving section in a circumferential direction. The at least one supporting element can be arranged opposite to the displacement zone. Thus, the at least one supporting element may be shaped as a channel with an essential semi-circular footprint or cross-section. This channel is optimally shaped for receiving the plug member and for guiding it in the mating procedure.

The above embodiments of the supporting elements allow for a precise guidance of the movement of the plug inside the receiving section in and against the mating direction, as at least parts of the outer wall guiding section rest on the supporting surface sections of the supporting elements when the plug is at least partially inserted into the receiving section. Furthermore, forces acting onto areas of the receiving section outside of the actuating sections are led into the plug member, on which the receiving section rests via the supporting surfaces.

Inside the housing, a conductor arrangement with at least one electrical conductor housed in a sealing jacket can be arranged. The sealing jacket may be shaped with at least one sealing rib, which can extend around the circumference of the jacket and which may indicate away from the conductor. Such a conductor arrangement permits a sealed and, for instance, dust or waterproof plug assembly between the socket and the plug.

In another advantageous embodiment of the plug, the plug may comprise at least one further deformation pocket, which can essentially be arranged abreast the outer wall guiding section in the mating direction. Thus, the outer wall guiding section and the deformation pocket can be arranged after each other in a circumferential direction of the plug member. If such a plug is inserted into the socket described above such that the supporting elements and the deformation pockets are located next to each other, the stabilizing effect of the supporting elements is efficiently combined with a maximum ease of use of the plug connection, this combination resulting in a secure and easy-to-handle plug connection. The deformation pocket can provide for a free deformation space, in which the adjacent deformation zone canevade, allowing for a small deformation of the displacement zones during the first deformation phase of the connecting procedure, reducing the force necessary for the connection of the plug and the socket. Hence, the deformation zone can be further deformed than without the deformation pocket, resulting in a larger possible displacement zone.

If the socket is shaped with at least two actuating zones, it can be advantageous if the plug comprises at least one further deformation pocket. The latching member may be arranged between the two deformation pockets and the outer wall guiding section can at least section-wise be arranged opposite to the latching member. The two actuating zones can be shaped to be equally deformed towards the interior of the receiving section and thus, each evade into one of the deformation pockets in equal measure. An embodiment with two displacement zones and two corresponding deformation pockets facilitates the symmetrical design of the socket and the plug and the advantages resulting herefrom and described above.

In yet another advantageous embodiment of the plug, the latching member can be arranged on a latching bar, which can extend in the mating direction and which may protrude from the plug member transversely to the mating direction. The latching bar may comprise a leading inclined displacement surface, which may indicate in the mating direction and away from the plug member and which can be arranged behind the deformation pocket in the mating direction.

When the plug is initially inserted in the housing during the first or deformation connection phase, the displacement surface interacts with a latching bridge, which is equipped with the latching element of the socket. In the mating direction before the latching bridge, a guiding recess which extends in and which widens against the mating direction, may align the latching bar, the bar being slightly narrower in the circumferential direction than the recess. While inserting the plug into the receiving section, the latching bridge and its latching element are pressed out of their initial position by the latching bar and its inclined displacement surface, which interacts with a displacement wall of the latching bridge facing against the mating direction. Upon further movement of the plug in the mating direction, the latching element reaches its deflected position. Until then, the force necessary for further inserting the plug into the socket increases in proportion to the depth of insertion and reaches a maximum shortly before the latching element has reached the deflected position. The receiving section is at least partially deformed and can even be stretched by the deflection of the latching element.

It can be maintained in this deflected position by the latching bar, which may comprise a sliding surface that faces in the radial direction and runs parallel to the mating direction. Against the mating direction, the latching member can follow the sliding surface. The latching member can be part of the latching bar and may extend between the sliding surface and a holding surface. The holding surface can be level with the outer wall guiding section in the radial direction and may extend against the mating direction. In the second or sliding phase, the latching bar can slide on the sliding surface, which reduces the force necessary for further inserting the plug suddenly. Only frictional forces have to be overcome.

The holding surface may end at a stop surface against the mating direction. This stop surface can be arranged opposite to and parallel with the latching member. The distance between the latching member and the stop surface can at least be equal to the length of the latching bridge in the mating direction. When the socket and the plug are completely mated, the latching bridge fits snugly between the latching member and the stop surface—a relative movement of the socket and the plug in and against the mating direction is blocked.

In another advantageous embodiment, the deformation indention may essentially extend around the plug member in a circumferential direction. A plug assembly with such a plug can be equipped with a socket, the displacement zones of which extend essentially completely around the receiving section in the circular direction, resulting in an actuating zone with a maximum size possible. Such an actuating zone is especially easy to deform—the plug assembly being very easy to handle. The deformation indention can be discontinued in the circumferential direction by the latching bar and at least one of the supporting elements. However, the latching or locking security of the plug assembly may be influenced by such a design.

Between at least one of the deformation pockets and the nearest actuating zones, the free actuating space can be arranged. This free actuating space enables a movement of the actuating zones towards the interior of the receiving section if the plug is partly mated with the socket.

The displacement zone and the latching element of the socket can be displaced from their initial position into their deflected position perpendicular to the mating direction and in the radial direction, thus, away from the plug member, when at least one of the actuating zones and especially two of them is pressed in a direction transverse to the mating direction into the nearest deformation indention, thus, against the radial direction.

The outer wall guiding section and the at least one deformation pocket may in another advantageous embodiment essentially be arranged consecutively in the mating direction. Thus, the at least one deformation pocket can essentially extend around the plug member in the circumferential direction.

The invention will be described hereinafter in greater detail and in an exemplary manner using advantageous embodiments and with reference to the drawings. The described embodiments are only possible configurations in which, however, the individual features as described above can be provided independently of one another or can be omitted in the drawings.

Figure 1:
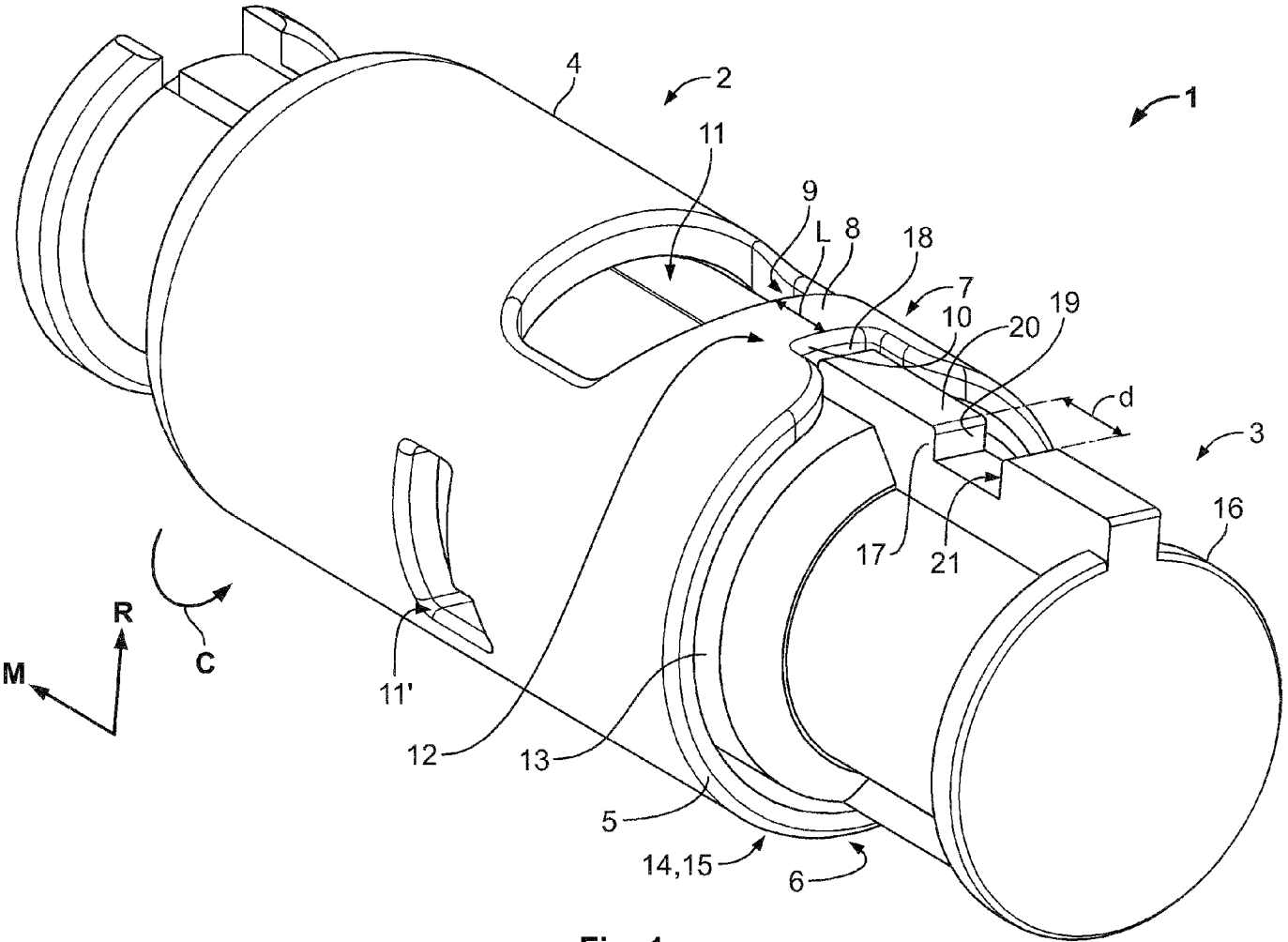
FIG. 1 is a schematic view of an exemplary embodiment of the invention.

First of all, a plug assembly 1 with an electrical socket 2 and an electrical plug with a plug member 3 configured according to the invention will be described with reference to FIG. 1, which shows a schematic view of a first embodiment of the invention.

The socket 2 and the plug member 3 are of an essentially cylindrical shape with a circular base. The socket 2 comprises a hollow receiving section 4, in which the plug member 3 can be inserted in a mating direction M. Against the mating direction M, the socket 2 ends with a collar 5, which surrounds a receiving opening 6 of the receiving section 4. The collar 5 is shaped essentially circular and comprises a guiding recess 7 that extends in and widens against the mating direction M. The guiding recess 7 can be formed as a slot running in the mating direction M and being open against the mating direction M and towards the interior of the receiving section 4.

In the mating direction M a latching bridge 8 follows behind the guiding recess 7. The latching bridge 8 is shaped with a latching element 9 which faces in the mating direction M—the latching element 9 is shaped as a latching wall that runs essentially perpendicular to the mating direction M. The latching bridge 8 is shaped with a displacement wall 10, which faces against the mating direction M. The displacement wall 10 can be aligned perpendicular to the mating direction M. Alternatively, the displacement wall 10 can at least section-wise be tilted towards the interior of the receiving section 4.

Further in mating direction M a weakening cut-out 11 follows the latching element 9. The weakening cut-out 11 extends in the mating direction M and in a circumferential direction C of the receiving section 4, which runs transversely to the mating direction M. Due to the weakening cut-out 11 and the generally flexible nature of the elastically deformable receiving section 4, a displacement zone 12, which extends in mating direction M between at least the latching element 9 and the displacement wall 10 can be more easily displaced in a radial direction R transverse to the mating direction M.

In order to decrease the force that is necessary to displace at least the displacement zone 12, further weakening cut-outs can be placed in a circumferential direction C next to the weakening cut-out 11. As an example, a second weakening cut-out 11' is shown, which is arranged abreast with the weakening cut-out 11 in the mating direction M.

The plug member 3 is shown partially inserted into the socket 2 in a pre-locking position. The plug member 3 can be made out of one piece, e.g. by injection moulding, or it can comprise two or more shell pieces. The plug member 3 is designed with an outer wall guiding section 13, which is almost completely inserted into the receiving section 4 in mating direction M. The outer wall guiding section is shaped cylindrically and comprises an essentially circular cross-section transverse to the mating direction and fits snugly into the hollow receiving section 4 of the socket 2. The outer wall guiding section 13 as well as the inner wall of the hollow receiving section 4 can be designed with further guiding means like guiding recesses and guiding noses.

In mating direction M before the outer wall guiding section 13, plug member 3 is shaped with a smaller cross-section compared to the outer wall guiding section 13. The diameter of the plug member 3 is especially reduced in the area of a deformation indention 14 that is formed by a setoff 15 in the plug member 3. The outer wall of the plug member 3 sets back from the outer wall guiding section 13 towards the interior of the plug member 3 and against a radial direction R, which extends perpendicular to the mating direction M and away from the plug member 3.

The indentation 14 extends in the mating direction M between the outer wall guiding section 13 and an end piece 16 of the plug member 3, which can continue in another part of the plug and through which electrical conductors like wires can reach. In the circumferential direction C, the indentation 14 extends almost round the plug member 3.

The plug member 3 is provided with a latching bar 17 that extends in the mating direction M and that protrudes from the plug member 3 or its outer wall guiding section 13 perpendicular to the mating direction M. The latching bar 17 comprises a leading inclined displacement surface 18 that indicates in the mating direction M and away from the plug member 3. The displacement surface 18 abuts on the displacement wall 10 of the latching bridge 8. In the circumferential direction C, the guiding recess 7 is only a little wider than the latching bar 17, which is guided in the recess 7. Against the mating direction M, the guiding recess 7 expands in its course.

In the mating direction M, before the displacement surface 18, a latching member 19 faces against the mating direction M. The latching member 19 is part of the latching bar 17 and projects at least section-wise from the outer wall guiding section 13 of the plug member 3. Between the displacement surface 18 and the latching member 19, a sliding surface 20 is placed, the sliding surface 20 running in the mating direction M and connecting the displacement surface 18 with the latching member 19. The sliding surface 20 forms a part of the latching bar 17 that is farthest away from the outer wall guiding section in the radial direction R.

In the mating direction M opposite to the latching member 19, a stop surface 21 is arranged in a distance that is bigger than the length of the latching bridge 8 in the mating direction M. The stop surface 21 protrudes from the outer wall guiding section 13 at least as far as the latching member 19.

Figure 2:
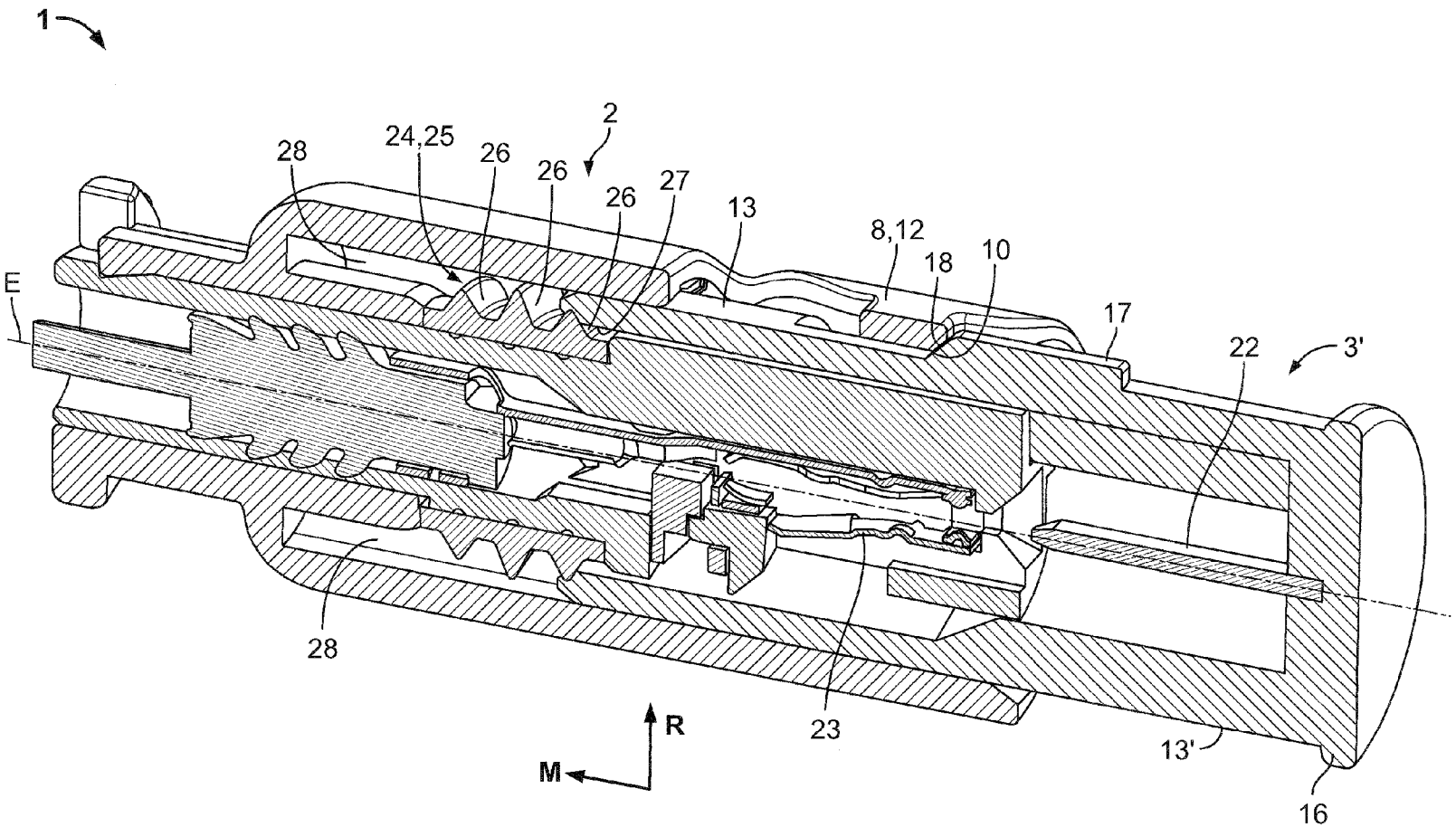
FIG. 2 is a schematic cross-sectional view of another exemplary embodiment.

FIG. 2 shows a further exemplary embodiment of the plug assembly 1 according to the invention in a cross-sectional view along a joint longitudinal axis E of the socket 2 and the plug member 3, the same reference signs being used for elements which correspond in function and structure to the elements of the exemplary embodiment of FIG. 1. For the sake of brevity, only the differences from the exemplary embodiment of FIG. 1 will be looked at.

In FIG. 2, the plug assembly 1 comprises the electrical socket 2 and an electrical plug member 3'. The electrical plug member 3' differs from the plug member 3 of FIG. 1 in that the deformation indention does not completely extend around the plug member 3' in the circumferential direction C, and in that the plug member 3' does not comprise a stop surface 21. Rather, a section 13' of the outer wall guiding section 13, which is arranged opposite of the latching bar, extends until the end piece 16 of the plug member 3'.

In this cross-sectional view it is evident that the displacement wall 10 and the inclined displacement surface 18 are section-wise extending parallel to each other. In this pre-locking or pre-connecting position, the plug member 3' is inserted into the socket 2 so far that the displacement wall 10 and the inclined displacement surface 18 are in contact with each other. A contact pin 22 of the plug member 3', however, is not yet in contact with a counter contact 23 of the socket 2, the pin 22 and the contact 23 both extending along the axis E, which extends in mating direction M.

The counter contact 23 is part of a conductor arrangement 24, which also comprises a sealing jacket 25, in which the counter contact 23 and maybe further counter contacts are housed. The sealing jacket 25 is made of an electrical insulating material and comprises three sealing ribs 26 that are arranged after each other in the mating direction M and extend around the circumference of the jacket 25, thereby indicating away from the contact 23. The sealing ribs 26 can be elastically deformed. In the pre-contact position, an inner sealing wall 27, sealingly contacts at least one of the sealing ribs 26. The outer wall guiding section 13 clings on an inner surface 28 of the receiving section 4, which can guide the plug member 3'.

Figure 3:
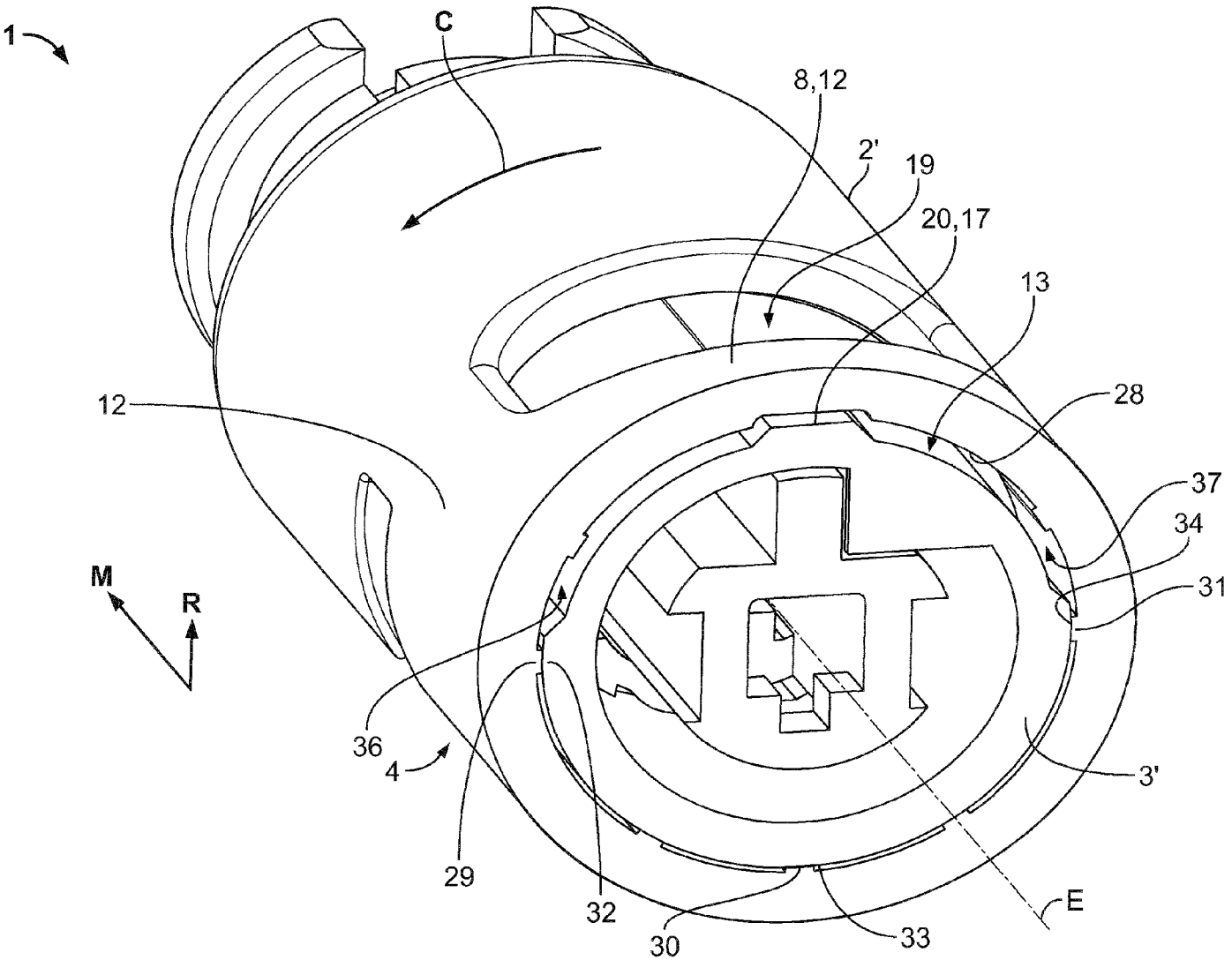
FIG. 3 shows a further embodiment of in a schematic cross-sectional view, wherein the plug member is further inserted into a mating socket.

FIG. 3 shows another embodiment of the plug assembly 1 in a schematic cross-sectional view, the sectional plane being arranged transversely to the mating direction M and abreast the displacement zone 12. Same reference signs are being used for elements, which correspond in function and structure to the elements of the exemplary embodiment of FIG. 1 or 2. For the sake of brevity, only the differences from the exemplary embodiment of FIG. 1 or 2 will be looked at.

The plug assembly 1 comprises the plug member 3' shown in FIG. 2 and an electrical socket 2'. The plug member 3' is further inserted into the socket 2' in mating direction M compared to FIGS. 1 and 2. Still, the plug member 3' and the socket 2' are not latched yet. The latching bridge 8 has been displaced from its initial position shown in FIGS. 1 and 2 into a deflected position perpendicular to the mating direction M and away from the plug member 3', as indicated by the arrow standing on the latching bridge 8 and indicating in the radial direction R. This displacement is caused by an interaction between the displacement wall 10 of the latching bridge 8 and the inclined displacement surface 18 during the insertion of the plug member 3'. The sliding surface 20 stands above the outer wall guiding section 13 in the radial direction R transverse to the mating direction M and holds the latching bridge 8 in the deflected position.

On the inner guiding surface 28 of the hollow receiving section 4, three supporting elements 29 to 31 are arranged and project into the interior of the receiving section 4 towards the axis E. Each of the supporting elements 29 to 31 is shaped with a supporting surface section 32 to 34, that extends in the mating direction M at a constant distance to the inner surface 28 in the radial direction R. The supporting elements 29 to 31 extend at least in the area of the displacement zone 12 and guide the plug member 3'. Additionally, the supporting elements 29 to 31 prevent the receiving section 4 from unfavourable deformation.

The supporting element 30 is arranged opposite to the latching member 19. The other two supporting elements 29, 31 are essentially arranged symmetrically to a plane extending through the latching member 19 and the axis E and opposite to each other at a maximum possible distance.

Alternatively, the supporting elements 29 to 31 can be allocated differently. Furthermore, the amount of supporting elements 29 to 31 can differ from the displayed exemplary embodiment. For instance, there can only be the supporting element 30, which may be arranged opposite to the latching member 19 and which can extend over half of the inner guiding surface 28 of the receiving section 4 in the circumferential direction C. The supporting surface section 33 of such a supporting element 30 can span the supporting surface sections 32 and 34 of the supporting elements 29 and 31. In another possible embodiment, the socket 2' can comprise only two supporting elements 29, 31, that are arranged symmetrical to the displacement zone 12 and at arbitrary positions. However, supporting elements 29 and 31 are especially advantageously placed if they are arranged at the maximum distance to each other or closer to the supporting element 30.

Around the latching bar 17, deformation pockets 36, 37 are provided in the outer wall guiding section 13 of the plug member 3'. The deformation pockets 36, 37 are formed as cavities or impressions in the outer wall guiding section 13 and extend in the circumferential direction C between the supporting elements 29, 31 and the latching bar 17 and are symmetrically shaped with respect to the latching bar 17 or to a plane extending through the latching bar 17 and the supporting element 30.

In the area of the deformation pockets 36, 37, the receiving section 4 is not supported on the plug member 3' and can therefore e.g. by deformation be moved further to the inside of the socket 2' towards the plug member 3'. This movement might result from the deformation of the receiving section 4, caused by the displacement of the latching bridge 8 during the insertion of the plug member 3' into the hollow receiving section 4.

Figure 4:
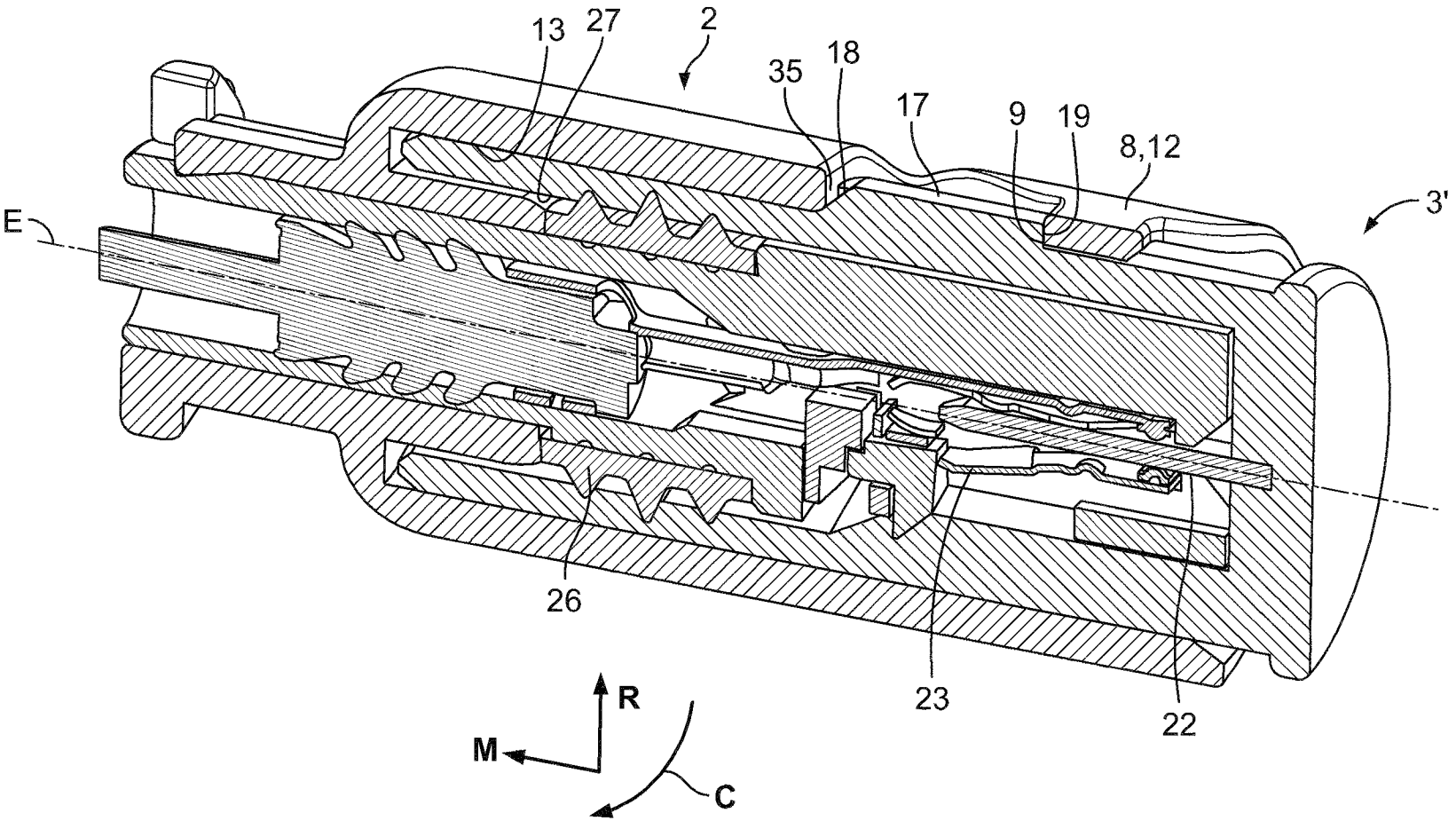
FIG. 4 is a schematic cross-sectional view of another exemplary embodiment of the invention, in which the plug member and the socket are completely mated.

FIG. 4 shows a further exemplary embodiment, the plug member 3' being completely inserted into the socket 2 in the mating direction M. Same reference signs are used for elements, which correspond in function and structure to the elements of the exemplary embodiment of FIG. 1 to 3. For the sake of brevity, only the differences from the previous embodiments will be looked at.

Plug member 3' is inserted into the socket 2 so far, that the latching member 19 has been moved until behind the latching bridge 8 in mating direction M. The latching element 9 of the latching bridge 8 is in close contact with the latching member 19 of the latching bar 17. The inclined displacement surface 18 has been pushed against a rear border 35 of the weakening cut-out 11, the rear border 35 pointing against the mating direction M and extending in the circumferential direction C. Either the inclined displacement surface 18 or the rear border 35 or both of them, are slightly elastically deformed, this deformation resulting in a force acting against the mating direction M and pressing the latching element 9 and the latching member 19 together.

The state of insertion shown in FIG. 3 is an intermediate state between the positions shown in FIGS. 2 and 4. In FIG. 2, the displacement zone 12 is yet undisplaced and in its initial position; the first or deformation phase of the connecting procedure is about to begin. In FIG. 3, the displacement zone 12 has been maximally deflected in the radial direction R; the connecting procedure is in the second or sliding phase. Finally, in the state of insertion as shown in FIG. 4, the displacement zone 12 has returned from the deflected position to a locking position, which is closer to the initial position than the deflected position. The connecting procedure has reached the third or latching phase. Contact pin 22 is completely contacted with the counter contact 23 and all sealing ribs 26 are in contact with the inner sealing wall 27 of the plug member 3'.

Figure 5:
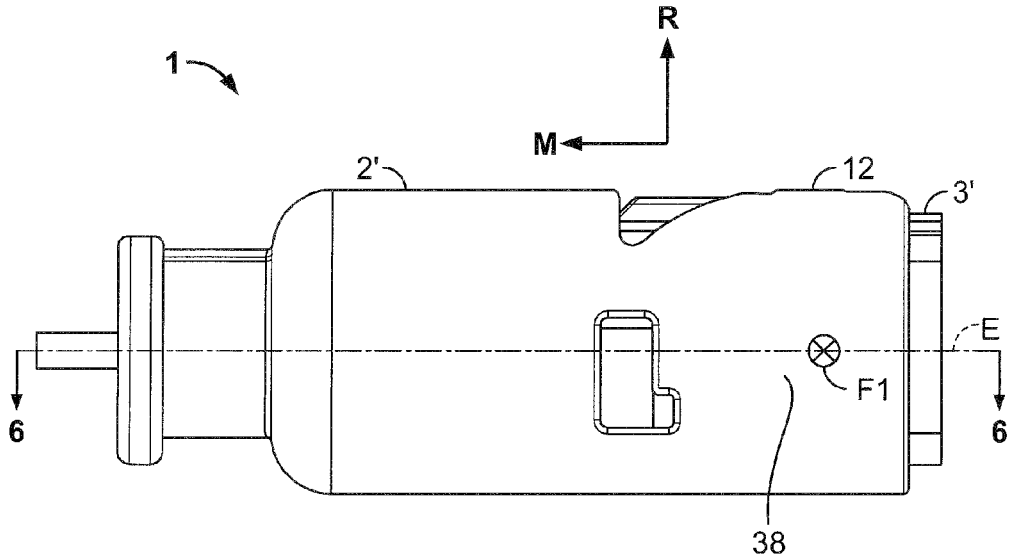
FIG. 5 is a schematic side view of the exemplary embodiment of FIG. 4.
Figure 6:
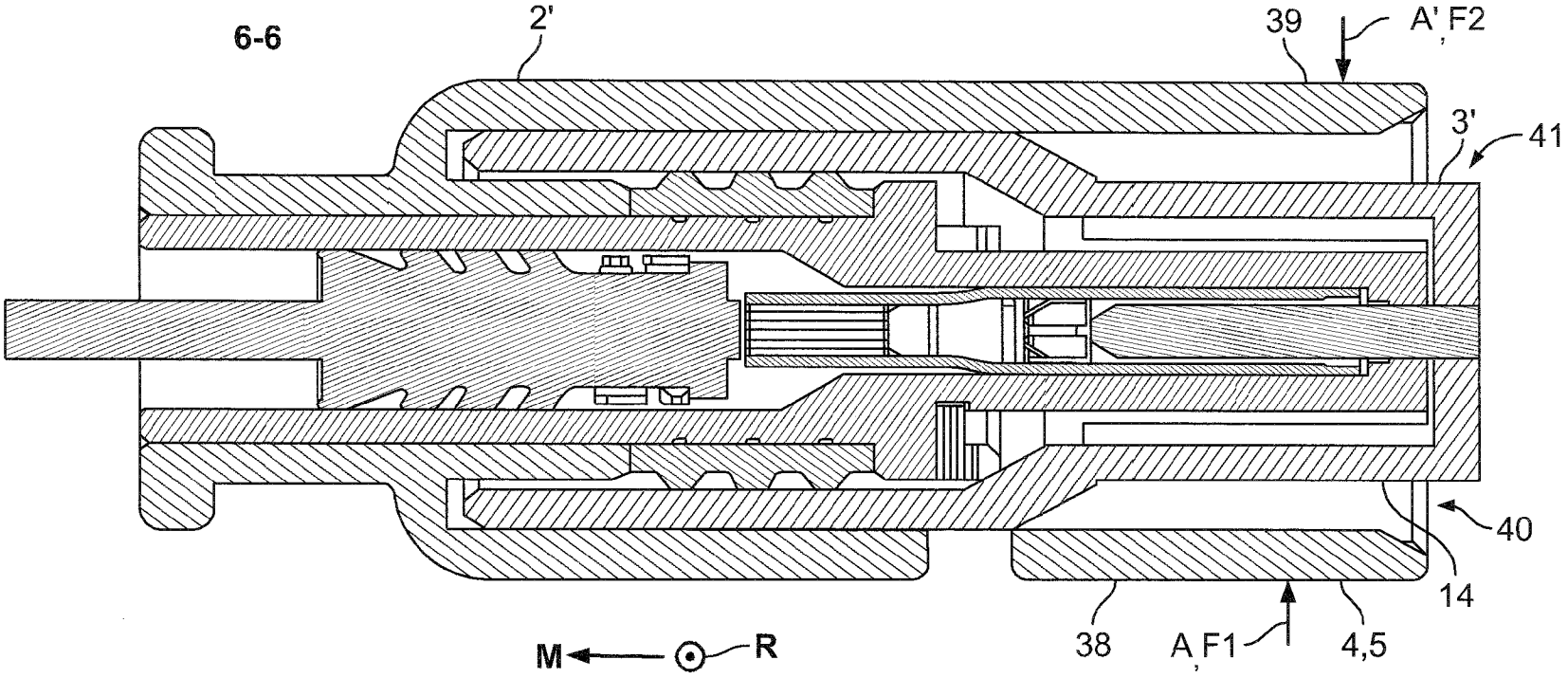
FIG. 6 is a schematic cross-sectional view of FIG. 5.

FIGS. 5 and 6 show the exemplary embodiment of FIG. 4, the same reference signs being used for elements, which correspond in function and structure to the elements of the exemplary embodiments of FIGS. 5 and 6. For the sake of brevity, only the differences from the previous exemplary embodiments will be looked at.

In FIG. 5, the plug connection 1 is shown with the plug member 3' that is completely mated with the socket 2'. The line B-B is in alignment with the longitudinal axis E and marks a cutting plane, along which a sectional view of FIG. 6 is shown.

Manual forces F1, F2 are each acting onto one of the two actuating zones 38, 39, the actuating zones 38, 39 being symmetrically arranged with respect to the displacement zone 12. By the manual forces F1, F2, the actuating zones 38, 39 are deformed and displaced in actuating directions A, A' that run against the radial direction R into free actuating spaces 40, 41, which are included in the deformation indentation 14. By action of the forces F1, F2, especially the collar 5 of the hollow receiving section 4 can be displaced or deformed until it is in contact with the deformation indentation 14.

The deformation of the actuating zones 38, 39 forces the displacement zone 12 to perform an evading movement into the radial direction R caused by the deformation of the actuating zones 38, 39, by which the latching element 9 is moved from its home or locking position into a deflected or unlocking position. In the unlocking position, the latching element 9 and the latching member 19 do not overlap in the mating direction M. The plug member 3' can be removed from the socket 2' against the mating direction M.

Figure 7:
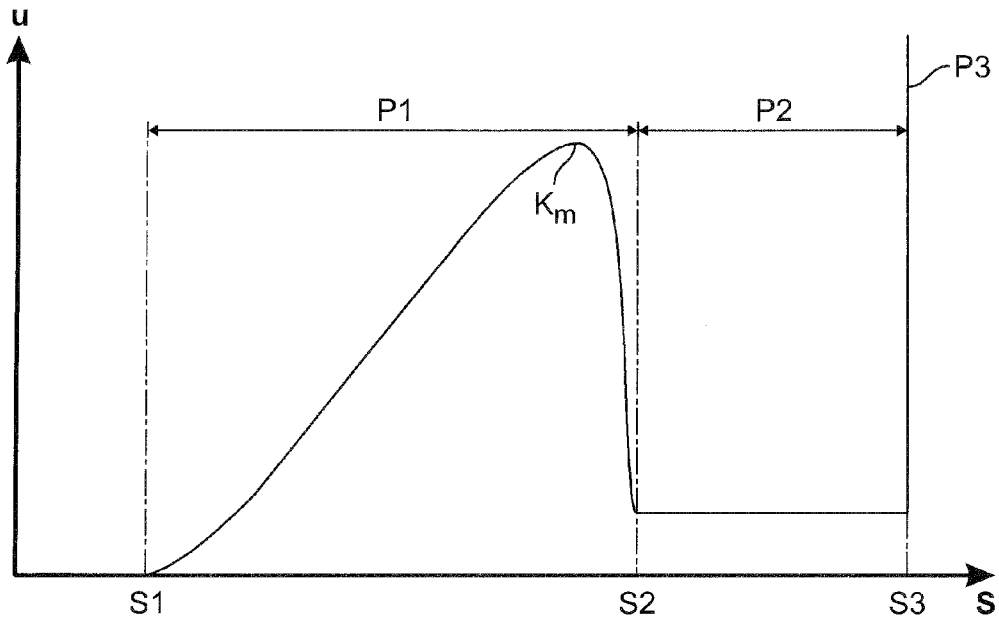
FIG. 7 is a schematic view of the dependency of a connecting force from connecting phases.

FIG. 7 shows another exemplary embodiment, the same reference signs being used for elements, which correspond in function and structure to the elements of the exemplary embodiments of FIG. 1 to 5. For the sake of brevity, only the differences from the previous exemplary embodiments will be looked at.

In FIG. 7, the connecting force K, which has to be overcome in order to insert the plug member 3, 3' into the electrical socket 2, 2' is shown in dependence of the amount or distance S of insertion of the plug member 3, 3' in the hollow receiving section 4. At distance S1, the connecting procedure begins with the start of the first phase P1. The plug member 3, 3' has been inserted such that the inclined surface 18 of the latching bar 17 is in contact with the displacement wall 10 of the latching bridge 8. If the plug member 3, 3' is during this first or deformation phase P1 further inserted into the receiving section 4 beyond the point S1, the latching bridge 8 is displaced and the connecting force K increases. The further the plug member 3, 3' is inserted into the receiving section 4, the further is the latching bridge 8 displaced. Just before the latching bridge 8 reaches the deflected position, the connecting force K reaches its maximum Km. In order to move the plug in mating direction M in the phase P1, a high connecting pressure has to be applied.

As soon as the plug member 3, 3' is even further inserted into the receiving section 4 in mating direction M and especially if the plug is inserted as far as the distance S2, the latching bridge 8 is positioned on the sliding surface 20 of the latching bar 17 and the second or sliding phase P2 begins. As in this position only frictional forces between the plug and the socket 2, 2' occur, the connecting force K drops rapidly to a minimum level. A person, who inserts the plug into the socket 2, 2' feels this drop of the connecting force K, as under constant high connecting pressure the plug member 3, 3' suddenly moves forward in mating direction M and reaches its connecting position in the socket 2, 2' by jerks and jolts. In this connecting position, the plug member 3, 3' has reached position S3. The second or sliding phase P2 is finished and the connection procedure has reached the final third latching phase.

The invention claimed is:

1. Electrical socket with a housing that is adapted to be mated with an electrical plug in a mating direction, the housing comprising a hollow and essentially cylindrical receiving section for receiving the plug, with at least one actuating zone that is adapted to be manually elastically deformed in an actuating direction running perpendicular to the mating direction and towards the interior of the housing, and with a displacement zone, which comprises a latching element that faces in the mating direction, the displacement zone being adapted to move from a initial position to a deflected position in a radial direction running perpendicular to the mating direction and away from the interior of the housing when the at least one actuating zone is deformed in the actuating direction, wherein the receiving section comprises at least one supporting element, which is arranged on an inner surface of the receiving section and which projects into the interior of the receiving section, the supporting element comprising at least one surface section facing to the interior of the receiving section.

2. The socket according to claim 1, wherein the actuating zone is arranged between the displacement zone and the supporting element.

3. The socket according to claim 1, wherein the supporting element is arranged in the actuating zone.

4. The socket according to claim 1, wherein the socket comprises at least one further actuating zone and that the actuating zones are arranged opposite to each other.

5. The socket according to claim 4, wherein the actuating zones and the supporting elements are arranged symmetrically around the displacement zone.

6. The socket according to claim 1, wherein the socket comprises at least one additional supporting element and that the supporting elements are arranged at a maximum distance to each other on the inner surface of the receiving section.

7. The socket according to claim 1, wherein the socket comprises at least one further supporting element that is arranged opposite to the displacement zone.

8. The socket according to claim 1, wherein the supporting surface section of the at least one supporting element essentially extends over half of the inner surface of the receiving section in a circumferential direction, the at least one supporting elements being arranged opposite to the displacement zone.

9. The socket according to claim 1, wherein a conductor arrangement with at least one electrical contact housed in a sealing jacket is arranged in the socket, the sealing jacket being shaped with at least one sealing rib, which extends around the circumference of the jacket and which indicates away from the contact.

10. Electrical plug with an essentially cylindrical plug member, the plug member extending in a mating direction and being adapted to be mated with an electrical socket, the plug member comprising at least one outer wall guiding section, which extends in the mating direction, and with a latching member, which faces against the mating direction and which at least section-wise projects from the plug member in a radial direction perpendicular to the mating direction, wherein the plug member comprises at least one deformation indentation that extends into the mating direction and that is located before the guiding section in the mating direction, and wherein the latching member comprises an inclined displacement surface at a front end thereof defining the radially outwardmost position of the plug member.

11. Plug according to claim 10, wherein the at least one deformation indentation essentially extends around the plug member in a circumferential direction.

12. Plug according to claim 10, wherein the plug comprises at least one deformation pocket, which is essentially arranged abreast the outer wall guiding section in the mating direction.

13. Plug according to claim 10, wherein a plug member comprises one further deformation pocket, the latching member being arranged between the deformation pockets, and the outer wall guiding section at least sectionwise being arranged opposite to the latching member.

14. Plug according to claim 10, wherein the latching member is arranged on a latching bar that extends in the mating direction and protrudes from the plug member transversely to the mating direction, the latching bar comprising the inclined displacement surface, which indicates in the mating direction and away from the plug member and which is arranged behind the deformation indentation in the mating direction.

15. Plug assembly, comprising at least one plug and at least one socket, the socket being adapted to be mated with the plug and the socket has at least one supporting surface section, wherein the socket is configured accordingly to claim 1 and/or the plug is formed according to claim 10, wherein the at least one supporting surface section rests on the plug member at least when the plug and the socket are partly mated in the mating direction.

* * * * *